US008490370B1

(12) United States Patent
Riggleman

(10) Patent No.: US 8,490,370 B1
(45) Date of Patent: Jul. 23, 2013

(54) SADDLE PAD ASSEMBLY

(76) Inventor: Nancy B. Riggleman, Paxton, IL (US)

( * ) Notice: Subject to any disclaimer, the term of this patent is extended or adjusted under 35 U.S.C. 154(b) by 0 days.

(21) Appl. No.: 13/277,576

(22) Filed: Oct. 20, 2011

(51) Int. Cl.
*B68C 1/12* (2006.01)

(52) U.S. Cl.
USPC ..... 54/66

(58) Field of Classification Search
USPC ..... 54/66, 44.5, 65, 79.1, 79.3
IPC ..... B68C 1/12
See application file for complete search history.

(56) References Cited

U.S. PATENT DOCUMENTS

| | | | | |
|---|---|---|---|---|
| 4,683,709 | A | 8/1987 | Vasko et al. | |
| 4,974,397 | A | 12/1990 | Ricken | |
| 5,299,412 | A | 4/1994 | Cudney et al. | |
| D350,420 | S | 9/1994 | Cudney et al. | |
| 6,474,052 | B2 * | 11/2002 | Kempsell et al. | 54/44.6 |
| 6,523,332 | B1 * | 2/2003 | Erb | 54/44.5 |
| 6,615,568 | B1 * | 9/2003 | Roskies | 54/66 |
| 7,487,628 | B2 | 2/2009 | Foster | |
| 2007/0006555 | A1 * | 1/2007 | Italiano | 54/66 |
| 2009/0031679 | A1 * | 2/2009 | Braden | 54/66 |

* cited by examiner

*Primary Examiner* — Son T Nguyen
*Assistant Examiner* — Shadi Baniani

(57) ABSTRACT

A saddle pad assembly provides padding under a saddle while facilitating customization to inhibit undesirable pressure points from developing. The assembly includes a cover having a closed end and a perimeter wall extending from the closed end. An edge of the perimeter wall defines an open end opposite the closed end. A plurality of holes extends through the perimeter wall of the cover. The holes are arranged into a pair of opposed rows extending between the closed end and the open end. A pad is insertable into the cover through the open end. The pad has a row of apertures alignable with the rows of holes. A line may be laced through the rows and the apertures to couple the pad to the cover.

7 Claims, 5 Drawing Sheets

SADDLE PAD ASSEMBLY

BACKGROUND OF THE DISCLOSURE

1. Field of the Disclosure

The disclosure relates to saddle pad devices and more particularly pertains to a new saddle pad device for providing padding under a saddle while facilitating customization to inhibit undesirable pressure points from developing.

2. Summary of the Disclosure

An embodiment of the disclosure meets the needs presented above by generally comprising a cover having a closed end and a perimeter wall extending from the closed end. An edge of the perimeter wall defines an open end opposite the closed end. A plurality of holes extends through the perimeter wall of the cover. The holes are arranged into a pair of opposed rows extending between the closed end and the open end. A pad is insertable into the cover through the open end. The pad has a row of apertures alignable with the rows of holes. A line may be laced through the rows and the apertures to couple the pad to the cover.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
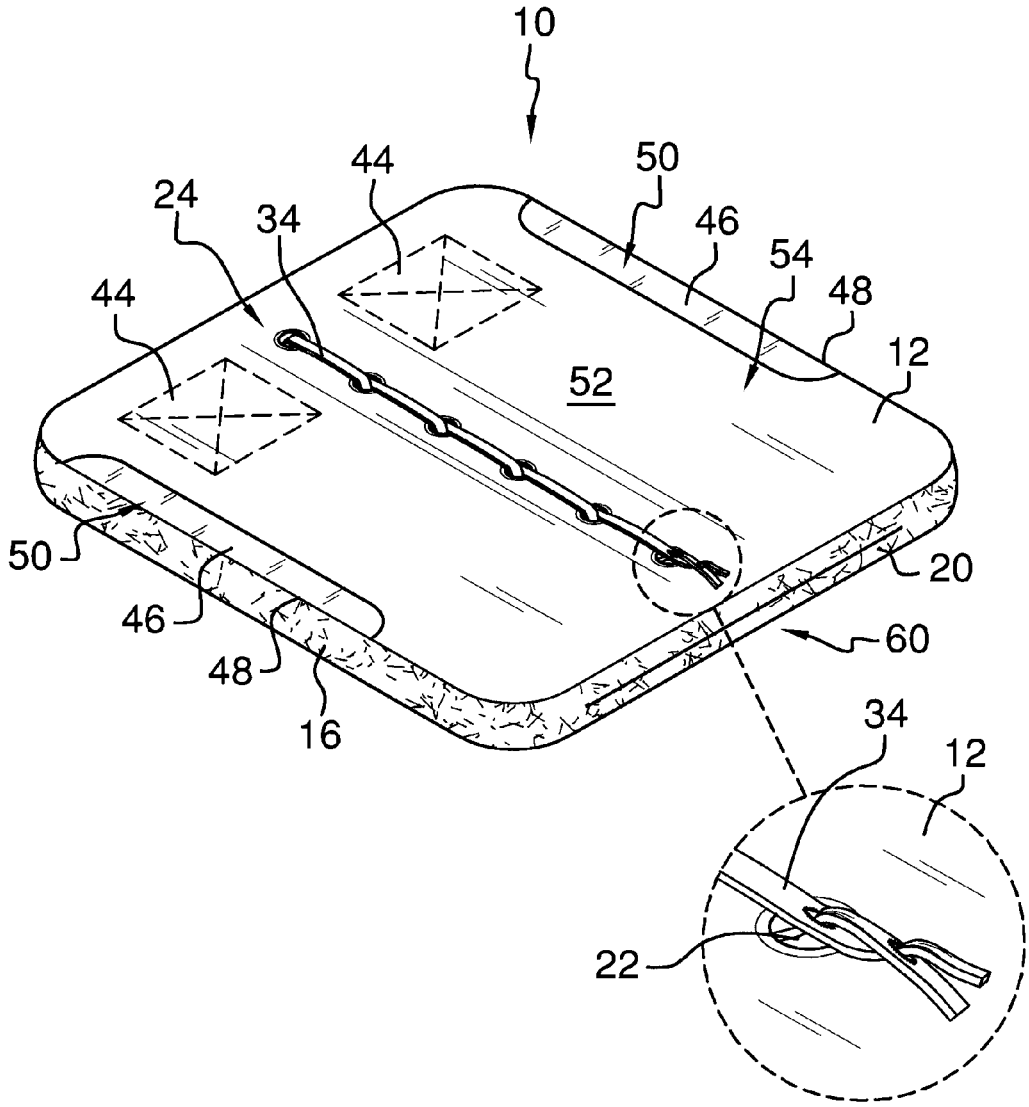
FIG. 1 is a top front side perspective view of a saddle pad assembly according to an embodiment of the disclosure.
Figure 2:
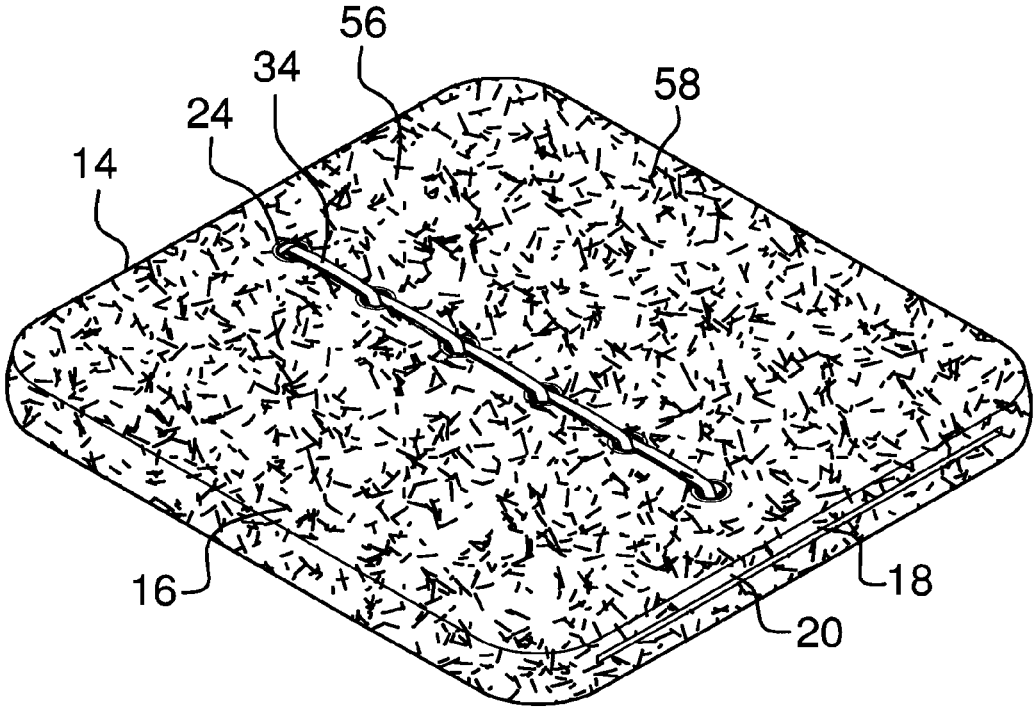
FIG. 2 is a bottom rear side perspective view of an embodiment of the disclosure.
Figure 3:
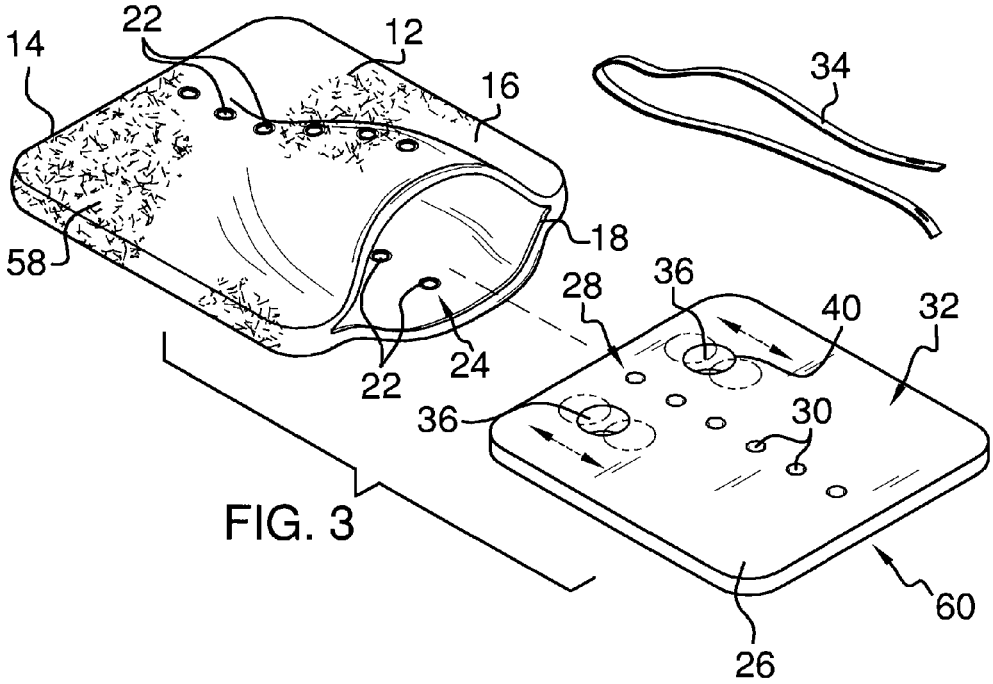
FIG. 3 is an exploded view of an embodiment of the disclosure.
Figure 4:
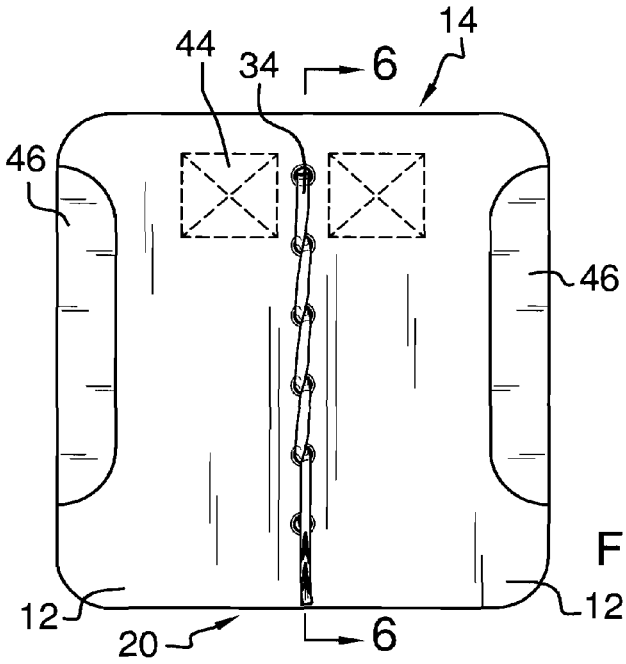
FIG. 4 is a top view of an embodiment of the disclosure.
Figure 5:
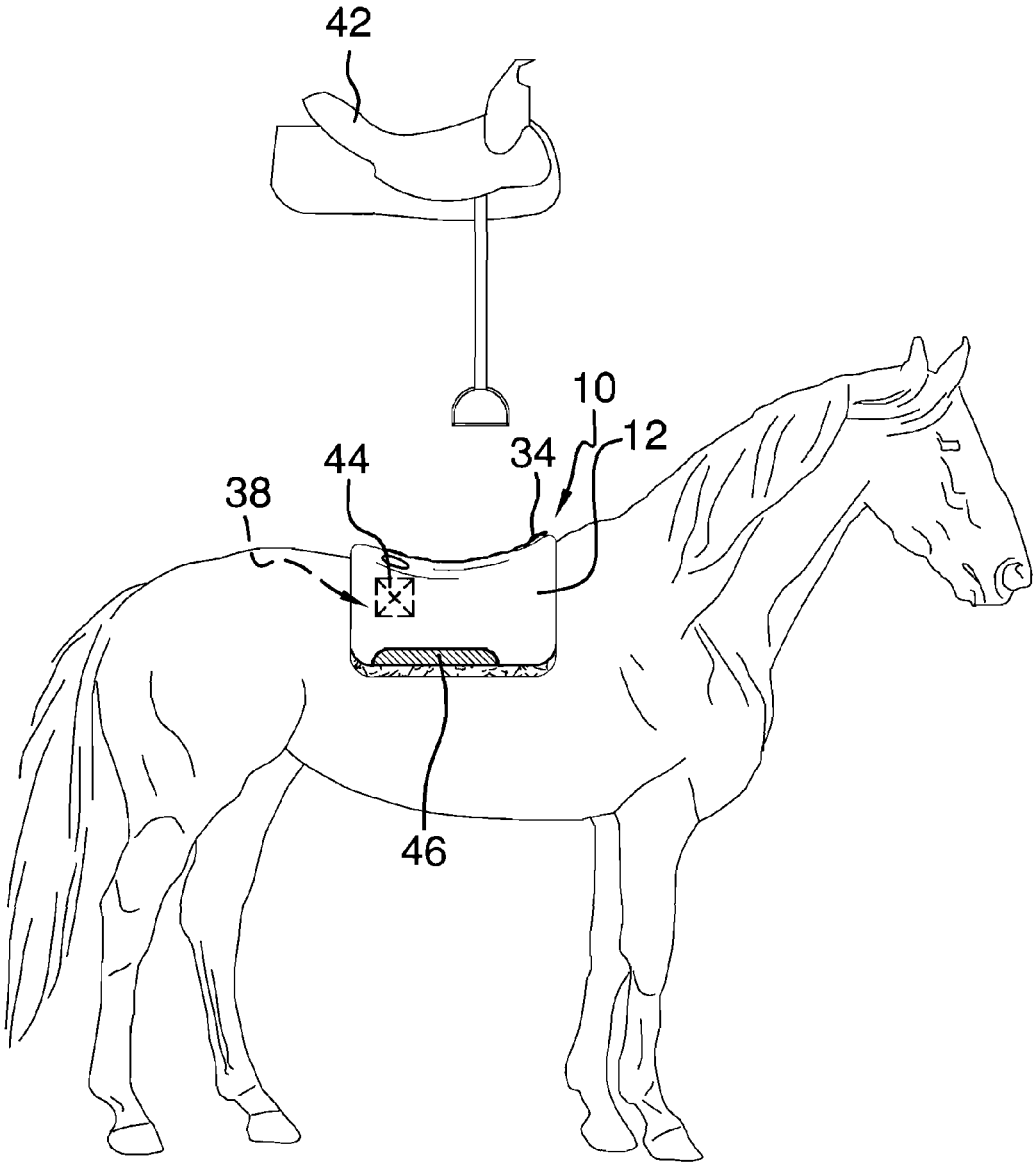
FIG. 5 is a side view of an embodiment of the disclosure in use.
Figure 6:
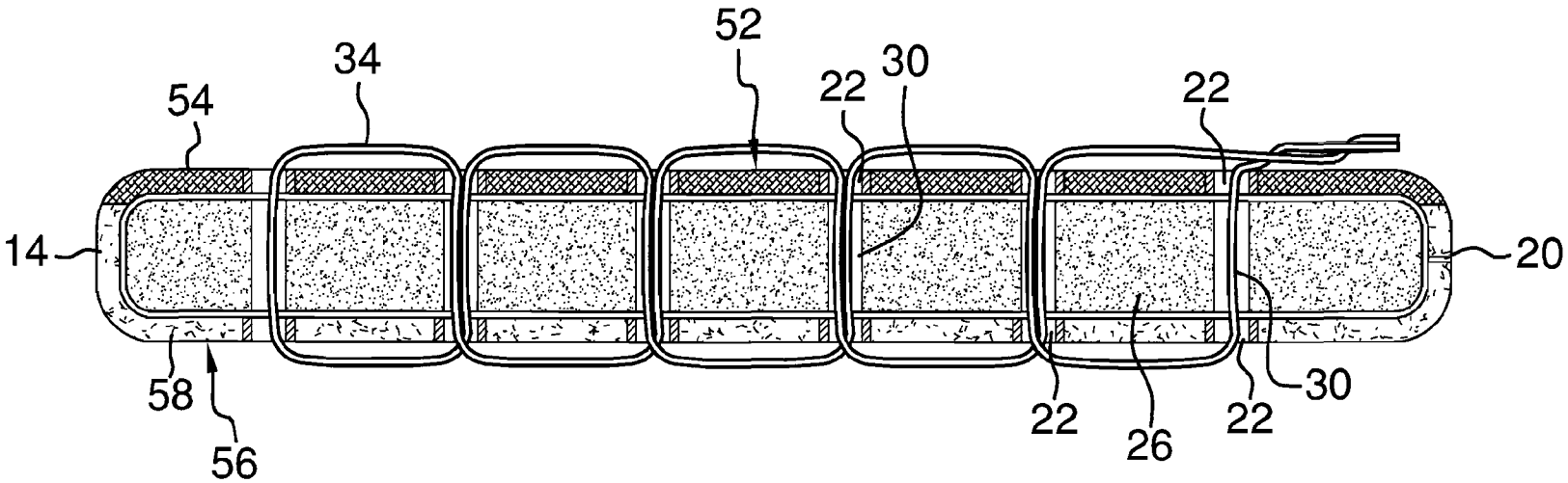
FIG. 6 is a cross-sectional view of an embodiment of the disclosure taken along line 6-6 of FIG. 4.

With reference now to the drawings, and in particular to FIGS. 1 through 6 thereof, a new saddle pad device embodying the principles and concepts of an embodiment of the disclosure and generally designated by the reference numeral 10 will be described.

As best illustrated in FIGS. 1 through 6, the saddle pad assembly 10 generally comprises a cover 12 having a closed end 14 and a perimeter wall 16 extending from the closed end 14. An edge 18 of the perimeter wall 16 defines an open end 20 opposite the closed end 14. A plurality of holes 22 extends through the perimeter wall 16 of the cover 12. The holes 22 are arranged into a pair of opposed rows 24 extending between the closed end 14 and the open end 20. A pad 26 is insertable into the cover 12 through the open end 20. The pad 26 has a row 28 of apertures 30. The row 28 of apertures 30 is alignable with the rows 24 of holes 22. The rows 24 and row 28 may be positioned to align with a center line 60 of the pad 26 and cover 12. The pad 26 is constructed of a compressible foam material 32.

A line 34 may be laced through the rows 24 of holes 22 and the row 28 of apertures 30 to securely couple the pad 26 to the cover 12. A cavity 36 may be provided in the pad 26 or cut into the pad 26 by a user in a desired location. The cavity 36 is positioned and configured for alignment with a pressure point 38 such that a perimeter edge 40 of the cavity 36 surrounds the pressure point 38. A saddle 42 may be positioned on the pad 26 such that the saddle 42 is supported in spaced relationship to the pressure point 38 by the pad 26.

A reinforcement patch 44 is coupled to the perimeter wall 16 of the cover 12. The reinforcement patch 44 is positioned adjacent to the cavity 36. The patch 44 may be sized and positioned over an area likely to correspond to potential pressure points. Thus, the cavity 36 may be cut into the pad 26 in a desired position customizing the pad 26 to a specific animal. The patch 44 enhances stiffness of the cover 12 adjacent to the cavity 36 to promote spacing of the saddle 42 from the pressure point 38.

A pair of strips 46 may be coupled to the perimeter wall 16 of the cover 12. The strips 46 are positioned extending along opposite sides 48 of the cover 12 and may be constructed of leather 50. The strips 46 provided durability and reinforcement along the opposite sides 48.

A top surface 52 of the perimeter wall 16 may be constructed of canvas 54 to enhance durability where friction will occur between the saddle 42 and the cover 12. A bottom surface 56 of the perimeter wall 16 may be constructed of sheepskin 58 to provide durability in combination with enhanced comfort to the animal.

In use, the pad 26 is customized by cutting the cavity 36 into the pad 26 at the desired position to provide spacing between the saddle 42 and the pressure point 38. The pad 26 is inserted into the cover 12 aligning the rows 24 with the row 28. The line 34 securely couples the pad 26 to the cover 12. The positioning of the line 34 assists in conforming the pad 26 to the curved back of the animal. The saddle 42 is then placed over the pad 26 and secured to the animal. The assembly 10 may be disassembled and reassembled as desired to refine positioning of the cavity 36 or facilitate cleaning of the pad 26 and cover 12 as desired. Multiple pads 26 and covers 12 may be provided for interchangeable use.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A saddle pad assembly comprising:

a cover, said cover having a closed end and a perimeter wall extending from said closed end, an edge of said perimeter wall defining an open end opposite said closed end;

a plurality of holes extending through said perimeter wall of said cover, said holes being arranged into a pair of opposed rows extending between said closed end and said open end;

a pad insertable into said cover through said open end, said pad having a row of apertures, said row of apertures being alignable with said rows of holes;

a line laced through said rows and said apertures whereby said pad is coupled to said cover a cavity in said pad, said cavity being configured for alignment with a pressure point such that a perimeter edge of said cavity surrounds the pressure point and a saddle positioned on said pad is supported in spaced relationship to the pressure point by said pad; and a reinforcement patch coupled to said perimeter wall of said cover, said reinforcement patch being positioned above and surrounding said cavity wherein said reinforcement patch is configured for alignment with the pressure point.

2. The assembly of claim 1, wherein said pad is constructed of compressible foam material.

3. The assembly of claim 1, further including a pair of strips coupled to said perimeter wall of said cover, said strips extending along opposite sides of said cover.

4. The assembly of claim 3, wherein said strips are constructed of leather.

5. The assembly of claim 1, further including a top surface of said perimeter wall being constructed of canvas.

6. The assembly of claim 1, further including a bottom surface of said perimeter wall being constructed of sheepskin.

7. A saddle pad assembly comprising:

a cover, said cover having a closed end and a perimeter wall extending from said closed end, an edge of said perimeter wall defining an open end opposite said closed end;

a plurality of holes extending through said perimeter wall of said cover, said holes being arranged into a pair of opposed rows extending between said closed end and said open end;

a pad insertable into said cover through said open end, said pad having a row of apertures, said row of apertures being alignable with said rows of holes, said pad being constructed of a compressible foam material;

a line laced through said rows and said apertures whereby said pad is coupled to said cover;

a cavity in said pad, said cavity being configured for alignment with a pressure point such that a perimeter edge of said cavity surrounds the pressure point and a saddle positioned on said pad is supported in spaced relationship to the pressure point by said pad;

a reinforcement patch coupled to said perimeter wall of said cover, said reinforcement patch being positioned above and surrounding said cavity wherein said reinforcement patch is configured for alignment with the pressure point;

a pair of strips coupled to said perimeter wall of said cover, said strips extending along opposite sides of said cover, said strips being constructed of leather;

a top surface of said perimeter wall being constructed of canvas; and a bottom surface of said perimeter wall being constructed of sheepskin.

* * * * *